United States Patent [19]

Swidler et al.

[11] 4,325,627

[45] Apr. 20, 1982

[54] METHOD AND APPARATUS FOR LIQUID-DEVELOPING LATENT ELECTROSTATIC IMAGES

[75] Inventors: Ronald Swidler, Palo Alto; Kenneth W. Gardiner, Menlo Park, both of Calif.

[73] Assignee: Savin Corporation, Valhalla, N.Y.

[21] Appl. No.: 105,030

[22] Filed: Dec. 19, 1979

[51] Int. Cl.[3] ..... G03G 15/10

[52] U.S. Cl. ..... 355/10; 118/651; 118/661; 430/118; 430/119

[58] Field of Search ..... 355/3 R, 3 DD, 10; 430/106, 117, 118, 119; 118/647, 651, 661

[56] References Cited

U.S. PATENT DOCUMENTS

| | | | |
|---|---|---|---|
| 3,870,514 | 3/1975 | Sato et al. | 355/10 X |
| 3,907,423 | 9/1975 | Hayashi et al. | 355/10 |
| 4,052,959 | 10/1977 | Hayashi et al. | 355/10 X |
| 4,168,119 | 9/1979 | Nishimura et al. | 355/10 |
| 4,202,913 | 5/1980 | Klavan et al. | 430/106 |
| 4,248,522 | 2/1981 | Davis | 355/10 |

*Primary Examiner*—Fred L. Braun

*Attorney, Agent, or Firm*—Shenier & O'Connor

[57] ABSTRACT

In an electrostatic copier having an applicator electrode positioned closely adjacent but not touching the photoconductive surface on which there is a latent electrostatic image to be developed. The surface of the latent image and the surface of the applicator electrode move at the same speed, or the electrode may move at a greater speed. The electrode and the photoconductor are spaced from each other by a gap in the order of between three and six mils. The applicator roller is mounted with its lower segment immersed in a tank containing a developing liquid bearing charged toner particles. There is a mechanism for increasing the liquid to the gap, such as a drive for speeding the rotary electrode to more than the photoconductor speed. After the latent image has been developed, a metering roller, which is a roller whose surface moves in the direction opposite to the surface of the photoconductor, meters or dynamically removes a portion of the liquid from the developed image. The freshly developed image is then transferred to a carrier sheet. An arcuate field electrode is positioned between the metering station and the transferring station. The field electrode is biased to a potential of a sign opposite to the charge of the toner particles.

3 Claims, 4 Drawing Figures

FIG. 2
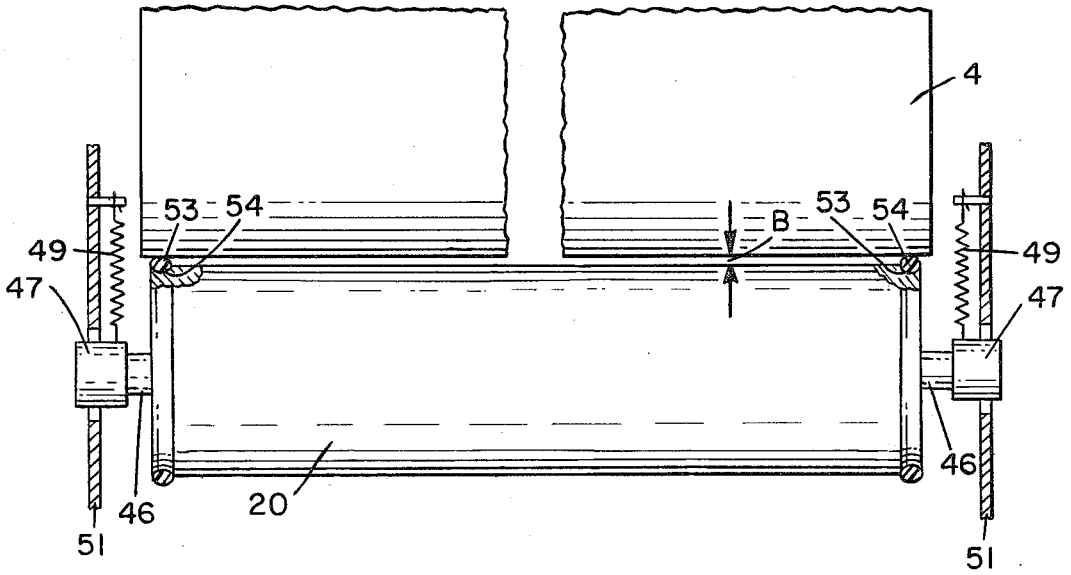
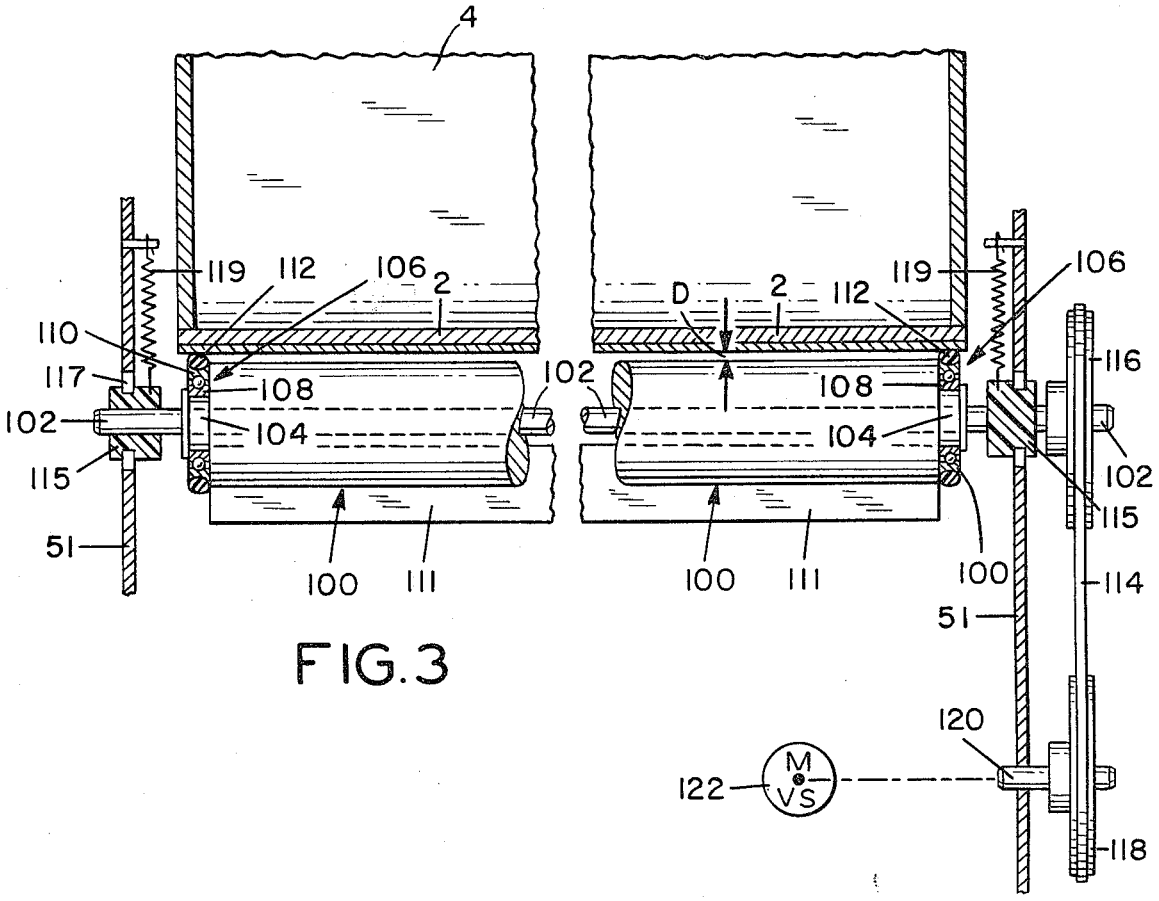
FIG. 3

METHOD AND APPARATUS FOR LIQUID-DEVELOPING LATENT ELECTROSTATIC IMAGES

CROSS-REFERENCE TO RELATED APPLICATION

This application is an improvement of our copending application, Ser. No. 14,434, filed Feb. 23, 1979, for "Improved Method and Apparatus for Developing Latent Electrostatic Images".

BACKGROUND OF THE INVENTION

There are a number of methods in the prior art for developing latent electrostatic images. These images may be formed by charging a photoconductive surface and then exposing the charged surface to light or ionizing radiations adapted to render the photoconductor conductive in the areas exposed to light or radiant energy and thus permit charges on the surface to be conducted to ground, in whole or in part. The latent electrostatic image may be formed on a dielectric sheet by energizing styli to form the desired electrostatic pattern on the surface of the dielectric sheet. The development of latent electrostatic images was first accomplished by the electrical attraction of fine particles to the charged areas forming the latent electrostatic image. Usually, these particles carried electrical charges opposite in polarity to the charges forming the latent electrostatic image. These particles were usually dry, from which the process derived the name "xerography". Later, it was discovered that particles could be suspended in a dielectric liquid and the latent electrostatic image could be developed by immersing it in the liquid. The particles moved through the liquid by electrophoresis, going to the charges of the image and developing it. The particles, of course, were visible so the image would become apparent.

When dry powder was used as the developing medium, it was usually transferred to plain paper or other carrier sheet and then fixed by fusing, the particles in this case, of course, being thermoplastic. This required heat to melt the heat-fusible resin forming or associated with the dry particles. If a carrier sheet, such as paper, was coated with a photoconductive material, such as zinc oxide, no transfer of the developed electrostatic image was required where the developer was a liquid carrying toner particles.

As the art developed, it was convenient, in order to eliminate the necessity of fusing a powder-developed image, to develop the latent electrostatic image with a liquid developer and then transfer the developed image to plain paper. The developer liquid usually comprised a hydrocarbon carrier, such as Isopar-G, or the like, through which were dispersed toner particles adapted to render the latent electrostatic image visible. The immersing of the photoconductive surface carrying the latent electrostatic image in a bath of liquid developer required wetting the entire surface of the photoconductor. The amount of liquid developer remaining on the developed image could be largely removed by a doctor roller. The remaining liquid, along with the developed image, would be transferred to paper, or other carrier, and had to be dried on the paper. This resulted in continual evaporation of a small amount of carrier liquid transferred from the photoconductive surface to the carrier paper. This evaporation was undesirable from several standpoints: First, the necessity of drying the sheet not only required energy, but the time involved in such operation limited the speed of copying. Furthermore, the ratio of liquid carrier to toner would constantly vary, depending on the amount of toner particles employed in the development process.

In the prior art, a stationary applicator adjacent the photoconductor was usually employed. In order to obtain complete development, the spacing between the stationary applicator and the photoconductor which was carried by a drum moving past the applicator was in the order of twenty mils. This large gap was necessary because it was exceedingly expensive to provide bearings for a drum which would ensure that there would be no contact between the photoconductor and the stationary applicator electrode. The mechanical precision involved in using a close clearance would increase the cost of manufacturing to an unacceptable point. The supplying of liquid developer to the gap between the stationary electrode and the rotary photoconductor ensured that the entire photoconductor became wetted with the developer liquid.

The art also attempted to overcome the difficulties experienced in employing an applicator roller in contact with the drum by using a compressible or resilient roller, formed with sponge-like material, which would apply liquid to the latent electrostatic image and then, as the pressure was released, suck the excess liquid from the photoconductive surface.

It was also attempted to overcome the difficulties experienced in employing an applicator roller by separating the applicator roller from the photoconductive surface and permitting the electrostatic field of the latent electrostatic image to pull the developing liquid from the applicator roller.

FIELD OF THE INVENTION

Our invention relates to an improved method and apparatus for liquid-developing latent electrostatic images by the use of a rotary applicator for feeding the toner to a gap between the rotary applicator and the photoconductor. The rotary applicator is biased to keep the non-image areas on the photoconductor free of toner particles. A reversely rotating metering roller removes excess developing liquid.

DESCRIPTION OF THE PRIOR ART

Wilmott U.S. Pat. No. 3,232,190 passes a tape bearing powdered toner particles closely adjacent a photoconductive drum. The dry particles are attracted to the latent image from the tape.

Oliphant U.S. Pat. No. 3,256,855 shows a pair of oppositely rotating rollers disposed with the lower ends in a tank of developing liquid. The rollers rotate in opposite directions so as to form a meniscus in the nip between the rollers. This meniscus applies developing liquid to the latent image. There is no metering roller, after development, for drying the freshly developed image. Oliphant does show biasing of the rollers to reduce the background. The gap, however, is obviously much greater than three to six mils. This means that the developed image will be very wet. One advantage of our new method is that the gap is such that the proper amount of developer liquid will be used for development, which liquid can be readily dried by the reverse roller.

Damm U.S. Pat. No. 3,560,204 uses a water-soluble ink and an applicator roller adapted to carry the ink to a point closely adjacent a photoconductor carrying a latent electrostatic image. The gap is a small one, but there is no flooding of the gap with ink; rather, an electrode is adapted to attract the ink over the air gap between the photoconductive drum and the latent image to develop the same. The arrangement in Damm is such that only the charge on the latent electrostatic image will be toned.

Deshayes et al U.S. Pat. No. 3,886,900 shows a method of reverse developing by using a conductive roller, the bottom of which is immersed in a bath of liquid developer. The roller rotates to carry toner into a gap between a photoconductive strip bearing a latent electrostatic image to develop the image. A field member is positioned in back of the photoconductive strip. Part of the field member is conductive, while part of it is insulating. When direct development is desired, the conductive outer surface of the field member is presented to the back of the photoconductive strip. When reverse development is desired, the nonconductive field-member back is presented to the back of the strip. A pair of drying rolls are used to remove excess liquid. Here again, there is no disclosure of the small gap in the area of three to six mils, and of course there is no reverse roller. The drying rollers will undoubtedly smear the developed image.

German Offenlegungsschrift No. 28 25 208, issued on an application filed by Canon K.K., of Tokyo, shows a porous, resilient applicator roller, adapted to contact the photoconductor, to apply liquid developer to the photoconductive surface by pressure. The arrangement is such that, as the drum moves away from the applicator roller, the release of pressure sucks excess developing liquid from the drum.

The same arrangement is shown in German Offenlegungsschrift No. 28 32 615, issued on another application of Canon K.K. The contacting of the applicator roller with the photoconductor abrades the photoconductor and causes it to wear, so that its life is substantially reduced.

SUMMARY OF THE INVENTION

In general, our invention contemplates a method and apparatus of employing liquid toners in plain paper copying machines, in which the development of the latent electrostatic image on the photoconductive surface is carried out by wetting with a developing liquid. This is accomplished by positioning a rotary applicator electrode so that it provides a gap with the photoconductive surface at their closest approach of between three to six mils. In order to apply liquid to the gap between the rotary electrode and the photoconductive surface, the lower end of the rotary electrode is immersed in a bath of liquid developer. As the rotary electrode turns, it carries the developing liquid to constantly flood the gap between the photoconductive surface which is conveniently carried by a drum. The rotary electrode is made of conductive material, such as metal or conductive plastic. It may be textured or smooth. The rotary electrode is biased to a voltage above the voltage of the non-image areas of the latent electrostatic image and of the same polarity as the electrostatic image. This will cause toner particles to remain on the rotary electrode, since they will not be attracted to the background or non-image areas. With stationary applicator electrodes, there is a fouling of the electrode with toner particles. In order to prevent this fouling to build up to close the gap, the polarity on the electrode must be reversed, from time to time, to clean the electrode. Our rotary electrode is furnished with a wiping blade or foam roller which keeps the rotary electrode clean. Because the rotary electrode is immersed in the developing liquid, the toner particles which are wiped by the wiping blade or foam roller are redisseminated through the developing liquid.

The mechanical precision involved in keeping close clearances would increase the cost of manufacturing electrophotocopying machines to an unacceptable point. We may supply the rotary applicator with end flanges which are provided with polyurethane tires. We have found that these tires may ride directly on the photoconductor and not wear or damage it. Any irregularities in the bearings of the drum carrying the photoconductor, or in the thickness of the photoconductor itself, will automatically be compensated for and the gap will remain constant. We have found that, in order for our invention to provide adequate copies at a sufficiently high speed, we must use a developing liquid having a solids content—that is, a preparation of toner particles of only one or two percent by weight. We are enabled to employ a hydrocarbon liquid fraction known as "Isopar-M". It has a boiling range between 410° F. and 485° F. Its flash point is 170° F., and it has a lower vapor pressure than Isopar-G.

Since an excess of developing liquid is applied to the photoconductor, this must be removed. We have found that a reverse roller, such as shown in U.S. Pat. No. 3,907,423 to Hayashi et al, serves admirably. We prefer to space the reverse roller, from the photoconductor on the rotary drum, one mil from the photoconductive surface. We have found that, in order to produce dense, dry copies, the spacing is extremely important. If there are variations in the gap owing to manufacturing errors which leave the photoconductor thicker in some places than in others, uniformity in dryness will not result. Furthermore, the photoconductor must be cleaned during each operation. There is wear of the photoconductor during this cleaning cycle. In order to prevent wear from the flanges which carry the reverse roller, we again use polyurethane tires on the bearing flanges. This substantially preserves the constancy of the gap between the reverse roller and the photoconductor and ensures there will be dryness of the completed copy while leaving the developed image moist enough to be completely transferred to the carrier sheet during the transfer operation. We have found a gap of 1.5 mils±5 to 8 microns produces excellent results.

Another salient advantage of using a small gap to apply developing liquid to the photoconductor bearing the latent electrostatic image, instead of a more widely spaced stationary electrode, is that intense fields are produced, resulting in very sharp edge development. These strong fields cannot be produced with a stationary applicator electrode.

OBJECTS OF THE INVENTION

One object of our invention is to provide a novel method for using liquid developers in plain paper electrophotographic copying machines, and the like, in which a rotary development electrode, spaced from the photoconductor on a rotary drum, continually supplies liquid developer to a small gap between the rotary electrode and the photoconductor.

Another object of our invention is to provide a rotary development electrode, the lower end of which is immersed in a bath and biased to prevent toner particles from being deposited on the non-image areas of the latent electrostatic image on the photoconductor, in which the gap between the photoconductor and the rotary applicator is maintained substantially constant.

Still another object of our invention is to provide a method of developing latent electrostatic images with a liquid developer having a solids content of two percent or less, in which a carrier-liquid component of low vapor pressure may be employed.

A further object of our invention is to provide a novel apparatus for employing a liquid developer for developing latent electrostatic images, in which the developing liquid is removed from the photoconductive surface by a reverse roller, and in which the gap between the reverse roller and the photoconductive drum is maintained substantially constant.

Other and further objects of our invention will appear from the following description.

BRIEF DESCRIPTION OF THE DRAWINGS

FIG. 2 is a side elevation taken along the line 2—2 of FIG. 1.

FIG. 3 is an elevation taken along the line 3—3 of FIG. 1.

DESCRIPTION OF THE PREFERRED EMBODIMENT

Figure 1:
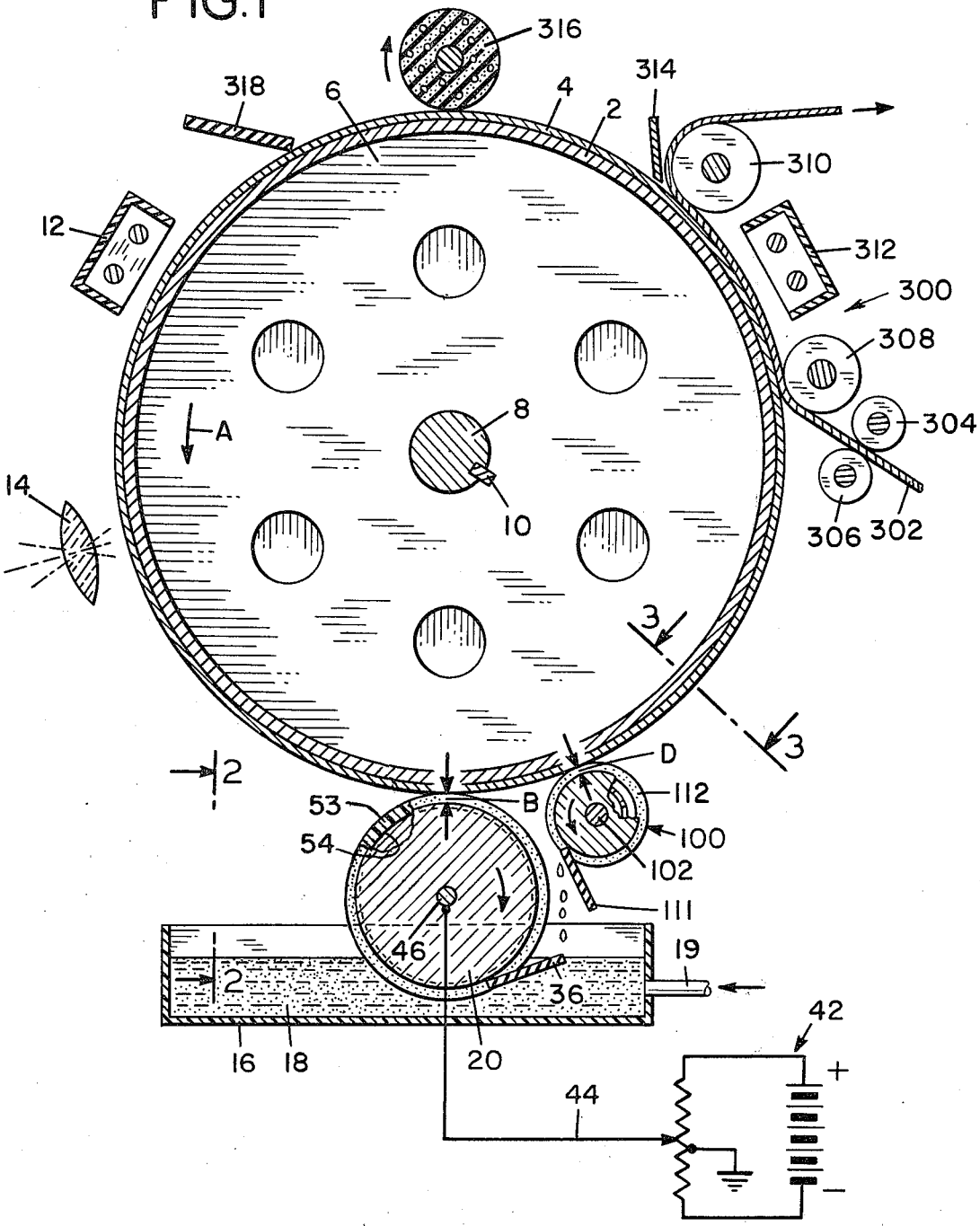
FIG. 1 is a diagrammatic view of an electrophotographic copying machine adapted to carry out the method of our invention.

More particularly, referring now to the drawings, a conductive drum 2, provided with a layer 4 of photoconductive material, is mounted by apertured discs 6 upon a shaft 8 and keyed thereto by key 10 for rotation therewith in a counterclockwise direction indicated by the arrow (A). The photoconductive drum and surrounding assembly are mounted in a lightproof housing (not shown), as is known in the art. The shaft 8 may be grounded or biased to any desired direct current voltage from a source (not shown), as is known in the art. A corona discharge device 12 is adapted to impose a charge on the photoconductor 4 as it passes the same. If the photoconductor is selenium, the charge will have a positive polarity. If the photoconductive material is resin-bound zinc oxide, or an organic photoconductive material such as polyvinyl carbazole, or the like, the charge will be negative.

After the photoconductor receives a charge, it passes lens 14, fitted in the housing and adapted to project an image which is desired to be reproduced upon the charged photoconductive surface. Since a photoconductor is an insulator in the dark and a conductor in the light, the impingement of the image pattern of light and shade upon the photoconductor will permit the areas of light to conduct the charge through the photoconductor to the conductive drum 2, thence through the disc 6, to the shaft 8, thus reducing the electrostatic charge in the light areas, while leaving the dark areas at their charge potentials. A latent electrostatic image will thus be formed on the surface of the photoconductor 4. This image will have a high potential in the order of 800 to 1000 volts above that of shaft 8 in the charged areas, though it may vary over wide limits. A tank 16, formed of insulating material, is adapted to contain a developing liquid 18. An applicator roller 20, which may be made of any appropriate conductive material which does not react with the carrier liquid of the developing liquid composition, is mounted adjacent the photoconductor. The roller may be made of metal or conductive plastic; it may be textured or smooth; and it is adapted to be biased, as will be pointed out more fully hereinafter.

The gap between the rotary applicator electrode and the photoconductive surface at the closest approach, indicated by opposing arrows (B), is not more than six mils. The use of a small gap is important, since the closer the applicator roller to the photoconductive surface, the more intense become the fields existing between the charge on the latent image and the applicator electrode. This produces sharp edge development, which cannot be conveniently accomplished with a stationary electrode.

The applicator electrode is furnished with integral grooves 54 carrying polyurethane tires 53 which ride upon the surface of the photoconductor 4. The rotary applicator 20 is carried by shaft 46 which is mounted on bearings 47 loosely supported on the machine frame 51. Springs 49 are connected between bearings 47 in the frame to bias the bearings such as to maintain the tires 53 in contact with the photoconductor 4. We have found that polyurethane tires produce no wear and constrain the rotary applicator electrode to rotate at synchronous speed with the photoconductive drum so that there is no relative movement between the rotary applicator and the photoconductor at the gap. This ensures that no shear forces are introduced. Since the gap (B) is critical, we ensure maintaining it by our construction. There is automatic compensation, owing to manufacturing errors which leave the photoconductor thicker in some places than in others. The cleaning of the photoconductor, which will be referred to hereinafter, introduces wear. Other manufacturing errors are introduced by inaccuracies in the bearings 47 for the shaft 46 of the rotary applicator electrode or the bearings (not shown) of the shaft 8 which carries the drum 2. The polyurethane tires, in contact with the photoconductor, automatically compensate for all of these errors and maintain the gap constant.

A lower segment of the rotary applicator electrode is immersed in the developing liquid 18. It is biased from any appropriate direct current source, indicated generally by the reference numeral 42, applied through conductor 44 to its carrying shaft 46. The bias, as pointed out above, should be such that it is of the same polarity as the charge on the photoconductor and of a voltage above the charge on the non-image areas but below the charge on the image areas. This will ensure that toner particles suspended in the developing liquid 18 will migrate only to the image areas, and not to the background or non-image areas. The wiper blade 36, which is also immersed in the developing liquid carried in tank 16, wipes toner particles deposited on the developing electrode from it and redisperses the toner particles through the developing liquid. In the instant case, the concept is to wet the entire photoconductive surface so that complete development can take place and then remove excess liquid after development.

A reverse roller 100 is carried by shaft 102 for rotation therewith, as can be seen by reference to FIG. 3. The shaft 102 is supported by discs 104, carried by ball bearings indicated generally by the reference numeral 106. The inner race 108 of ball bearings 106 supports the discs 104. Each outer race 110 of each ball bearing 106 carries a polyurethane tire 112 which bears against the photoconductive drum. The dimensions of the parts are such that the reverse roller 100 is spaced from the photoconductive surface by a gap (D), the spacing of which is in the order of one mil (0.001"). Bushings 115, through which shaft 102 passes, extend through openings 117 in the machine frame 51 and are urged upwardly by springs 119 to maintain the polyurethane tires 112 in contact with the photoconductive drum. The reverse roller 100 is driven by a belt or chain 114 which extends between a pinion or pulley 116 and a pinion or pulley 118. The pinion 118 rotates about a shaft 120 driven by a variable speed motor 122. If the copy which is being transferred to a carrier sheet is not sufficiently dry, the motor 122 may be speeded. The arrangement is described in Hayashi et al U.S. Pat. No. 3,907,423, referred to above.

The combination of a rotary biased applicator electrode closely spaced from but not contacting a photoconductor carried by a rotary drum, a developing liquid having a solids content of two percent or less by weight, and a reverse roller closely spaced to the photoconductive drum adapted to remove excess developer liquid from the drum after the electrostatic image has been developed, produces surprising results. We obtain a beautiful image which exhibits no background. We have been able to produce sixty letter-size sheets per minute. Furthermore, by the use of polyurethane tires for the rotary applicator electrode and for the bearings of the reverse roller, we maintain both the developing gap and the drying gap constant. These gaps are critical, and small variations in them produce discrepancies in the operation of our method and apparatus. By maintaining the gaps constant, in spite of variations in manufacturing tolerances in the thickness of the photoconductor and eccentricities of the photoconductive drum or applicator electrode, or both, we accomplish uniform, rapid, and beautiful reproductions of the originals being electrophotographed.

Referring again to FIG. 1, a wiper blade 111, in contact with the surface of the reverse roller 100, keeps the surface of the reverse roller clean. As the developer liquid 18 is depleted, a fresh supply may be introduced under suitable control means (not shown) through pipe 19. After the latent electrostatic image has been developed and metered by reverse roller 100, it may pass directly to the transfer station indicated generally by the reference numeral 300. At the transfer station, sheet material 302, to which the developed image is to be transferred, is fed by feeding rolls 304 and 306 to pressure roll 308, between which and roll 310 we position a transfer corona 312. The polarity of the corona discharge from transfer corona 312 is such as to charge the back of the carrier sheet to effect the transfer of the image from the photoconductive surface to the carrier sheet. This polarity should be opposite that of the charge of the developed image. If selenium is used, the corona charge will be highly positive. If an organic photoconductor is used, the corona charge will be negative. The image, which is now carried by the carrier sheet, is fed by roller 310 to a station for cutting, stacking, or collating, or to a tray for the user. A pickoff 314, of any desired type known to the art, will ensure the stripping of the carrier sheet from the surface of the photoconductor. The photoconductor may then be cleaned, as is known in the art, by a foam-rubber cleaning roll 316 driven by means (not shown) and the cleaned surface wiped by a wiping blade 318 so that the photoconductor is ready for reproducing the next original.

It is to be understood that the reverse roller is to be so controlled by the variable speed motor 122 that a certain amount of carrier liquid will be left in the developed image. With the use of Isopar-M, we have found that between seventy and eighty milligrams of moisture for a letter-size original produces good results. The amount of moisture will depend, to some extent, on the type of carrier sheet. If the carrier sheet is absorbent, seventy to eighty milligrams of moisture per copy will feel dry. If the paper is calendered and less absorbent, a smaller amount of moisture should be left in the developed image before transfer.

It is also important that sufficient developer liquid be presented to the gap (B) to flood the gap, since our solids content of toner particles is less than that used in our copending application, Ser. No. 14,434, above referred to. We have found that a solids content of about 1.1 percent by weight in respect of the carrier liquid operates satisfactorily, provided the gap is flooded with developing liquid.

Figure 4:
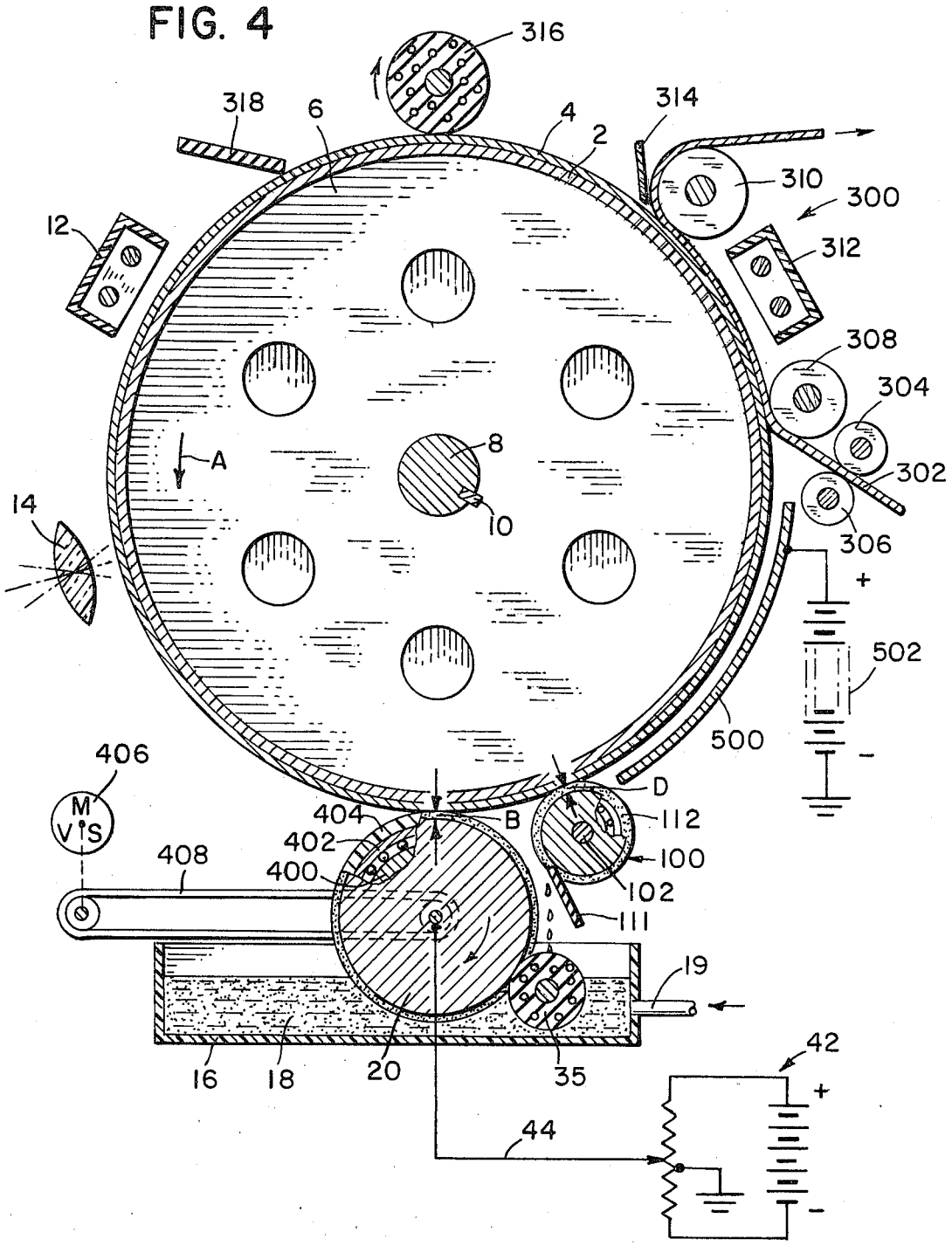
FIG. 4 is a diagrammatic view, similar to FIG. 1, showing another form of electrophotographic copying machine capable of carrying out the method of our invention.

Referring now to FIG. 4, in order to ensure that the gap is flooded with developing liquid, we mount our developer electrode 20 similarly to the mounting of the reverse roller. We provide an inner race 400, rotatable about an outer race 402, supported by ball bearings. The outer race 402 is provided with a polyurethane tire 404 bearing against the photoconductor 4 carried by the conductive drum 2. The gap (B) between the surface of the applicator electrode and the surface of the photoconductor lies between three and six mils. Instead of permitting the photoconductor to drive the applicator roller, we provide a variable speed motor 406 adapted to rotate the applicator electrode 20 in the direction shown by the arrow in FIG. 4 through a chain or sprocket drive 408.

It will be observed that by increasing the speed of the variable speed motor 406 we are enabled to drive the applicator roller such that it will deliver more developer liquid to the gap (B) than would be the case in the form of the invention shown in FIG. 1. It will also be appreciated that any appropriate means for delivering additional liquid to the gap (B) may be employed if such be desired. Whether or not additional liquid is required at the gap (B) will depend on the area of the image being developed. If a large amount of toner is required for the image, as would be the case in a pictorial image as distinguished from a typewritten document, the motor 406 will be speeded up to deliver more liquid. The applicator development rotary electrode 20, in the form of the invention shown in FIG. 4, is maintained clean by a wiper roller 35 instead of a wiper blade as shown in the form of the invention of FIG. 1. This wiper roller is made of foamed elastomeric material and is driven to rotate by any appropriate means (not shown).

We have also discovered that, after the image has been developed, the contrast of the image can be greatly improved by subjecting the developed image, after leaving the reverse roller and before it is transferred, to an electrical field having a polarity opposite to that of the toner. Referring again to FIG. 4, an arcuate field electrode 500 is positioned between the reverse roller 100 and the transfer station. This electrode is closely spaced to the photoconductor, preferably as close as conveniently possible within manufacturing tolerances and so that the developed image will not touch the field electrode. The field electrode increases the sharpness of the image after the developing liquid has been in use for some time. Use of the developing liquid appears to reduce the charge on the toner particles in the developing liquid. When the developing liquid is fresh and the toner particles are highly charged, the only effect of the field electrode is to aid in the complete transfer of the developed image from the photoconductor to the carrier sheet. The charge of the developed electrostatic image on the photoconductive drum, in the case of selenium, is negative. The presence of a positive field tends to draw the negatively charged particles of the developed image away from the drum, thus loosening the affinity of the developed image with the drum. In all cases, the image appears sharper, irrespective of the age of the toner particles in the developing liquid. The arrangement is such that the developed image is more completely transferred to the carrier sheet, which assists in reducing the cleaning problem, and a beautiful image of high contrast is achieved on the carrier sheet.

Our tests have shown that the gap (B) is critical in respect of developing liquids, a great many of which we have tested. If the gap is too close—that is, smaller than three mils—the quantity of toner present in the gap will be too small to produce an image of the desired density. If it is attempted to provide a developing liquid with a greater percentage of solids content than two percent, graying of the non-image areas becomes a problem unless a sufficiently great bias is used to prevent deposition on the background areas. This means that a large quantity of toner particles will be deposited on the rotary electrode and the operation is less than optimum owing to the fact that the toner composition will continually vary, depending on the success in redisseminating toner particles throughout the developing liquid. If these are not redispersed, the percentage of toner particles in the carrier liquid will become too small and the image density will suffer. If the gap is made too large, the advantage pointed out above, of having the development electrode as close as feasible to the latent electrostatic image, is lost. That is to say, if one attempts to use a fixed applicator electrode with a small gap, not only is there danger of shorting the electrode, but the gap is so small that enough fresh liquid developer cannot be supplied to the gap properly to tone the image. We have found that a gap of between three and six mils for a given toner produces optimum results from the new combination in which the gap and the toner content of the developing liquid are critical. The critical limits could not have been predicted.

It will be seen that we have accomplished the objects of our invention. We have provided a novel method of using liquid developers in plain paper electrophotographic copying machines, and the like, in which a rotary electrode spaced from the photoconductor (which is mounted on a rotary drum) continually supplies liquid developer to a small gap between the rotary electrode and the photoconductor, permitting electrophoretic development of the latent electrostatic image to take place at the gap. The applicator electrode is biased to prevent toner particles from being deposited on the non-image areas of the latent electrostatic image. Owing to the fact that the rotary applicator electrode has its lower segment immersed in a bath of developing liquid, toner particles which remain on the applicator electrode may be wiped from it and redispersed in the developing liquid. This prevents a buildup of toner particles on the applicator electrode which might bridge the gap. By providing polyurethane tires on the applicator electrode, the gap between the applicator electrode and the photoconductor remains constant, irrespective of wear of the photoconductor, inaccuracies in the thickness of the photoconductor, and eccentricities of either the applicator electrode or the drum carrying the photoconductor, or both. The reversely rotating metering electrode reduces the quantity of liquid remaining on the photoconductor to the proper amount. Its bearing flanges may likewise be provided with polyurethane tires so that the metering gap of the doctor roller remains constant. Our method and apparatus are such that we can produce faithful, substantially dry copies on carrier sheets at comparatively high speed.

We have provided means for supplying additional developing liquid to the gap to ensure that it is flooded and that sufficient developing liquid is in the gap completely to develop the latent electrostatic image. We are enabled to control the amount of liquid component left in the developed image, between seventy and eighty milligrams by weight in respect of an 8½" by 11" copy sheet. We have found that this amount of liquid not only enables electrophoresis to continue under the action of field electrode 500, but may readily be absorbed by a plain-paper carrier sheet to which the developed image is transferred. A suitable source of potential, such as battery 502, applies voltage to the field electrode 500, it being understood that shaft 8 is also connected to ground. The field electrode not only ensures a sparkling image of high contrast, irrespective of the age of the developing liquid, but also assists in the transfer of the developed image to the carrier sheet.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A method of developing latent electrostatic images wherein a latent electrostatic image is formed on a photoconductive surface, including the steps of applying developer liquid comprising a dielectric carrier liquid having charged solid toner particles disseminated therethrough from a bath of said liquid to said latent electrostatic image by a rotary conductive electrode, spacing said electrode from said photoconductive surface by a distance of between three and six mils to produce a gap between said electrode and said photoconductive surface, immersing the lower segment of said electrode in said bath, flooding said gap by rotating said rotary electrode, biasing said electrode to a polarity of the same sign as the polarity of said latent electrostatic image and to a voltage which is less in amplitude than the voltage of said latent electrostatic image but greater than the voltage of the background areas of said photoconductor, controlling the rotary speed of said electrode to ensure flooding said gap with developer liquid, removing a portion of the carrier liquid from said developed image while on said photoconductive surface by a reversely rotating roller spaced from the photoconductive surface by a distance in the order of one mil, then subjecting the developed image to an electric field having a polarity opposite to the polarity of the charge of said toner particles, and then transferring the developed image to a carrier sheet.

2. A method of developing latent electrostatic images wherein a latent electrostatic image is formed on a photoconductive surface, including the steps of applying developer liquid comprising a dielectric carrier liquid having charged solid toner particles aggregating two percent or less by weight of the dielectric liquid disseminated therethrough from a bath of said liquid to said latent electrostatic image by a rotary conductive electrode, spacing said electrode from said photoconductive surface by a distance of between three and six mils to produce a gap between said electrode and said photoconductive surface, immersing the lower segment of said electrode in said bath, flooding said gap by rotating said rotary electrode so that its surface speed is greater than the surface speed of said photoconductive surface, biasing said electrode to a polarity of the same sign as the polarity of said latent electrostatic image and to a voltage which is less in amplitude than the voltage of said latent electrostatic image but greater than the voltage of the background of said photoconductor, controlling the rotary speed of said electrode to ensure flooding said gap with developer liquid, removing a portion of the carrier liquid from said developed image while on said photoconductive surface by a reversely rotating roller spaced from the photoconductive surface by a distance in the order of one mil, and then transferring the developed image to a carrier sheet.

3. In an apparatus for making copies of a document by electrophotography, a rotatable conductive drum, a photoconductor carried by said drum, means for charging the photoconductor, exposing means for subjecting the charged photoconductor to a light image of a document to be copied to form a latent electrostatic image on said drum; the improvement comprising a tank for holding developer carrier liquid having charged toner particles disseminated therethrough, a rotary electrode, means for mounting said rotary electrode with its lower segment immersed in said carrier liquid and for spacing its uppermost segment from the photoconductor to form a gap therewith of between three and six mils at its closest approach to the photoconductor, means for biasing said rotary electrode to prevent toner deposition on the non-image areas of the latent electrostatic image formed on the photoconductor, means for controlling the speed of rotation of said rotary electrode to control the volume of developer liquid carried thereby from the tank to said gap, a reversely rotating metering roller for removing a portion of the carrier liquid from the developed image on the photoconductive surface, means for transferring the developed image to a carrier sheet, an arcuate field electrode closely spaced from the photoconductive surface and positioned between said metering roller and said transferring means, and means for biasing said field electrode to a polarity having a sign opposite to the polarity of the charge of said charged toner particles.

* * * * *

UNITED STATES PATENT AND TRADEMARK OFFICE

CERTIFICATE OF CORRECTION

PATENT NO. : 4,325,627

DATED : April 20, 1982

INVENTOR(S) : Ronald Swidler and Kenneth W. Gardiner

It is certified that error appears in the above–identified patent and that said Letters Patent are hereby corrected as shown below:

Column 11, line 23, after "background" insert -- areas --.

Signed and Sealed this

*Twenty-second* Day of *June 1982*

[SEAL]

*Attest:*

GERALD J. MOSSINGHOFF

*Attesting Officer*

*Commissioner of Patents and Trademarks*